United States Patent [19]

Kobayashi

[11] Patent Number: 4,513,717

[45] Date of Patent: Apr. 30, 1985

[54] IGNITION TIMING CONTROL DEVICE OF AN INTERNAL COMBUSTION ENGINE

[75] Inventor: Tatsuo Kobayashi, Susono, Japan

[73] Assignee: Toyota Jidosha Kabushiki Kaisha, Tokota, Japan

[21] Appl. No.: 473,609

[22] Filed: Mar. 9, 1983

[30] Foreign Application Priority Data

Mar. 18, 1982 [JP] Japan ..... 57-041682

[51] Int. Cl.[3] ..... F02P 5/04

[52] U.S. Cl. ..... 123/425

[58] Field of Search ..... 123/416, 417, 425

[56] References Cited

U.S. PATENT DOCUMENTS 4,233,944 11/1980 Omori et al. ..... 123/416

4,245,602 1/1981 Omori et al. ..... 123/416 X 4,351,281 9/1982 Geiger et al. ..... 123/425

4,370,963 2/1983 Iwata et al. ..... 123/425

*Primary Examiner*—Tony M. Argenbright

*Attorney, Agent, or Firm*—Kenyon & Kenyon

[57] ABSTRACT

An ignition control device of an engine comprising a knocking sensor. When a knocking does not occur, the ignition timing is maintained at an optimum ignition timing determined by the engine speed and the level of vacuum produced in the intake passage of the engine. When a knocking occurs, the ignition timing is retarded to an optimum ignition timing determined by the engine speed and the level of vacuum which is produced in the intake passage when the engine is operating in a wide open throttle.

10 Claims, 6 Drawing Figures

Fig. 3

| P \ N | --- | --- | n-1 | n | n+1 | --- | --- |
|---|---|---|---|---|---|---|---|
| P MIN | | | $Q^{n-1}_{MIN}$ | $Q^{n}_{MIN}$ | $Q^{n+1}_{MIN}$ | | |
| --- | | | | | | | |
| m - 1 | | | $Q^{n-1}_{m-1}$ | $Q^{n}_{m-1}$ | $Q^{n+1}_{m-1}$ | | |
| m | | | $Q^{n-1}_{m}$ | $Q^{n}_{m}$ | $Q^{n+1}_{m}$ | | |
| m + 1 | | | $Q^{n-1}_{m+1}$ | $Q^{n}_{m+1}$ | $Q^{n+1}_{m+1}$ | | |
| --- | | | | | | | |
| P MAX | | | $Q^{n-1}_{MAX}$ | $Q^{n}_{MAX}$ | $Q^{n+1}_{MAX}$ | | |

P
(mmHgabs)
800
600
400
200
θ
(degBTDC)
40
20
TDC
S
1
0
I
1
0
K N
3
2
1
0
C K N
0
FLAG PK
1
0
1000
2a
1001
1002
1003
1004
q1
c1 and d1
q2
c2
q3
c3
dn
cn
qm1
qm2
qm3
d2
d3
t1
t2
t3
180degCA
TDC
IGNITION
T1
T2

IGNITION TIMING CONTROL DEVICE OF AN INTERNAL COMBUSTION ENGINE

BACKGROUND OF THE INVENTION

The present invention relates to an ignition timing control device of an internal combustion engine.

An ignition timing control device is known, in which the ignition timing is maintained at an optimum ignition timing when a knocking does not occur, but the ignition timing is retarded relative to the optimum ignition timing when the knocking occurs. In such a conventional ignition timing device, the level of vacuum produced in the intake manifold or the amount of air fed into the cylinder of the engine is normally detected by a diaphragm type sensor or an air flow meter, respectively, and the ignition timing is controlled based on the result of the detection. In an engine, when the engine is abruptly accelerated from a light load operating state, the level of vacuum in the intake manifold abruptly becomes small, and the amount of air fed into the cylinder of the engine is abruptly increased. However, at this time, in a conventional ignition timing device, since the delay of detection is present in the diaphragm type sensor and the air flow meter, the ignition timing is temporarily maintained at an ignition timing which is optimum in the light load operating state immediately after the engine is abruptly accelerated. Nevertheless, since the optimum ignition timing in the light load operating state is considerably advanced relative to the optimum ignition timing in the heavy load operating state, the actual ignition timing is considerably advanced relative to the optimum ignition timing actually required for the engine immediately after the engine is abruptly accelerated. Consequently, at this time, even if the ignition timing is retarded in response to the initial occurrence of a knocking, it is difficult to suppress the successive occurrence of a knocking. This results in a continuous occurrence of knockings.

In addition, in a conventional ignition timing control device, the ignition timing is retarded everytime a knocking occurs. Consequently, when the diaphragm type sensor or the air flow meter produces an output signal which correctly indicates the level of vacuum in the intake manifold or the amount of air fed into the cylinder of the engine, respectively, a little while after the engine is abruptly accelerated, the ignition timing is considerably retarded relative to the optimum ignition timing which is actually required for the engine. As a result of this, a problem occurs in that the drivability of a vehicle and the specific fuel consumption deteriorate.

SUMMARY OF THE INVENTION

An object of the present invention is to provide an ignition timing control device capable of obtaining a good drivability and specific fuel consumption by suppressing the occurrence of a knocking when the engine is accelerated and by preventing the actual ignition timing from being considerably retarded relative to the optimum ignition timing which is actually required for the engine after the engine is accelerated.

According to the present invention, there is provided an ignition timing control device of an internal combustion engine having an intake passage and a spark plug, said device comprising: first means for detecting the level of vacuum produced in the intake passage and producing an output signal indicating said level of vacuum; second means for detecting the engine speed and producing an output signal indicating said engine speed; third means for detecting the occurrence of a knocking and producing an output signal indicating a knocking intensity; and electronic control means controlling the ignition timing of said spark plug in response to the output signals of said first means, said second means, and said third means, and storing therein a data map which indicates an optimum ignition timing corresponding to said level of vacuum and said engine speed, said optimum ignition timing including a first optimum ignition timing which corresponds to said engine speed and said level of vacuum, detected by said first means, and including a second optimum ignition timing which corresponds to said engine speed and said level of vacuum produced in the intake passage when the engine is operating in a wide open throttle, said electronic control means normally maintaining the ignition timing of said spark plug at said first optimum ignition timing, but retarding the ignition timing of said spark plug to the range of an ignition timing between said second optimum ignition timing and the midpoint of said first and said second optimum ignition timings when a knocking occurs.

In addition, according to the present invention, there is provided an ignition timing control device of an internal combustion engine having an intake passage and a spark plug, said device comprising: first means for detecting the amount of air flowing within the intake passage and producing an output signal indicating said amount of air; second means for detecting the engine speed and producing an output signal indicating said engine speed; third means for detecting the occurrence of a knocking and producing an output signal indicating a knocking intensity; and electronic control means controlling the ignition timing of said spark plug in response to the output signals of said first means, said second means, and said third means, and storing therein a data map which indicates an optimum ignition timing corresponding to said amount of air and said engine speed, said optimum ignition timing including a first optimum ignition timing which corresponds to said engine speed and said amount of air, detected by said first means, and including a second optimum ignition timing which corresponds to said engine speed and said amount of air flowing within the intake passage when the engine is operating in a wide open throttle, said electronic control means normally maintaining the ignition timing of said spark plug at said first optimum ignition timing, but retarding the ignition timing of said spark plug to the range of an ignition timing between said second optimum ignition timing and the midpoint of said first and said second optimum ignition timings when a knocking occurs.

The present invention may be more fully understood from the description of preferred embodiments of the invention set forth below, together with the accompanying drawings.

BRIEF DESCRIPTION OF THE DRAWINGS

In the drawings:

FIG. 3 is a schematically illustrated view of a data map stored in a ROM;

DESCRIPTION OF PREFERRED EMBODIMENTS

Figure 1:
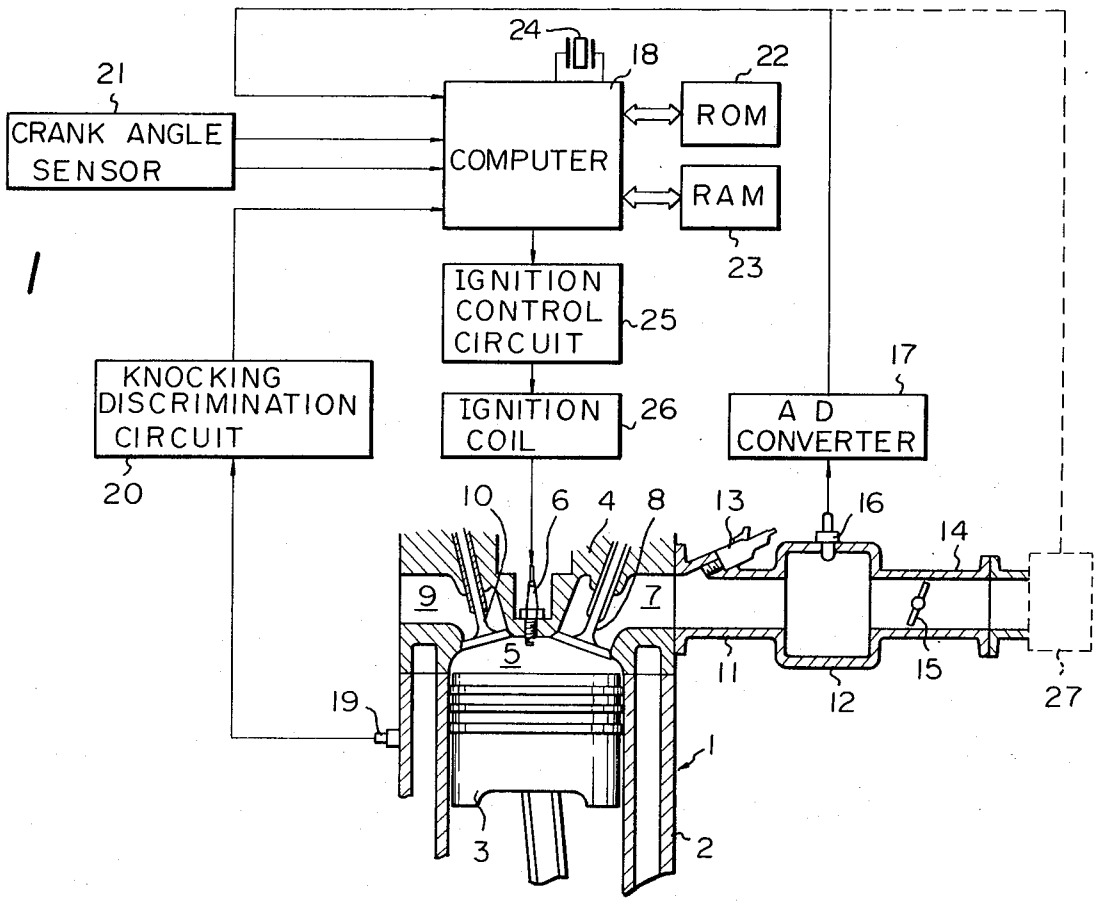
FIG. 1 is a cross-sectional view of an engine and a brock diagram of an ignition timing control device.

Referring to FIG. 1, reference numeral 1 designates an engine body, 2 a cylinder block, 3 a piston reciprocally movable in the cylinder block, and 4 a cylinder head fixed onto the cylinder block 2; 5 designates a combustion chamber formed between the piston 3 and the cylinder head 4, 6 spark plug arranged in the combustion chamber 5, 7 an intake port, and 8 an intake valve; 9 designates an exhaust port, and 10 an exhaust valve. The intake port 7 is connected via a branch pipe 11 to a surge tank 12 which is common to all the cylinders of the engine. A fuel injector 13 is provided for each cylinder and mounted on the branch pipe 11, and fuel is injected into the intake port 7 from the fuel injector 13. The surge tank 12 is connected to the outside air via an intake duct 14 and the air cleaner (not shown). A throttle valve 15 is arranged in the intake duct 14 and connected to the accelerator pedal (not shown).

A vacuum sensor 16, for detecting the level of vacuum in the surge tank 12, is mounted on the surge tank 12 and connected to the input terminal of a computer 18 via an AD converter 17. In addition, a knocking sensor 19 is mounted on the cylinder block 2 and connected to the input terminal of the computer 18 via a knocking discrimination circuit 20. The knocking discrimination circuit 20 produces an output signal indicating the intensity of the knocking. Furthermore, a crank angle sensor 21 is connected to the input terminal of the computer 18. This crank angle sensor 21 produces a pulse signal indicating that the piston 3 reaches the top dead center and also produces several crank angle signals per one revolution of the engine. The computer 18 comprises a read-only memory (ROM) 22 storing a hereinafter described optimum ignition timing therein, a random-access memory (RAM) 23 carrying out the write-in and the read-out of data, and a clock pulse generator 24 producing various clock signals. The output terminal of the computer 18 is connected to the spark plug 6 via an ignition control circuit 25 and an ignition coil 26.

Figure 2:
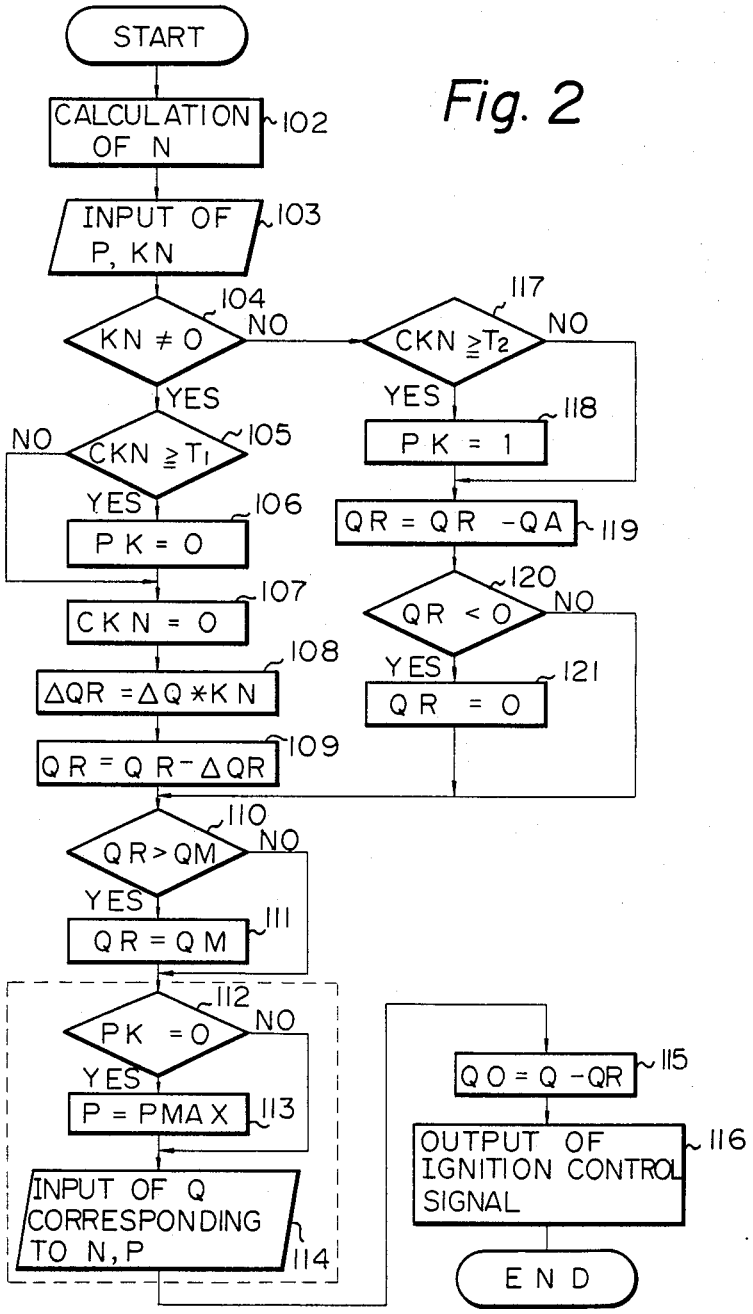
FIG. 2 is a flow chart illustrating an embodiment of an ignition timing control method according to the present invention.

The sequential processing of the ignition timing control, which processing is executed in the computer 18, will be hereinafter described with reference to the flow chart illustrated in FIG. 2. Referring to FIG. 2, a flag PK is used in the flow chart. This flag PK becomes "PK=0" when a knocking occurs after a predetermined time period $T_1$, during which a knocking does not occur, has elapsed. Then, the flag PK is maintained at "PK=0" until the time a predetermined time period $T_2$, during which a knocking does not occur, has elapsed. After this, when the predetermined time period $T_2$, during which a knocking does not occur, has elapsed, the flag PK becomes "PK=1". Then, the flag PK becomes again "PK=0" when a knocking occurs after the predetermined time period $T_1$, during which a knocking does not not occur, has elapsed as mentioned above. The time period $T_1$ is longer than the second period $T_2$. Consequently, the flag PK becomes "PK=0" and is maintained at "PK=0" thereafter only when the following two conditions (a) and (b) are satisfied, but the flag PK is maintained at "PK=1" in any other conditions.

(a) The flag PK becomes "PK=0" when a knocking occurs after a predetermined time period $T_1$, during which a knocking does not occur, has elapsed.

(b) After the flag PK becomes "PK=0", the flag PK is maintained at "PK=0" unitil the time the predetermined time period $T_2$, during which a knocking does not occur, has elapsed.

The computer 18 is constructed so that the flag PK becomes "PK=1" when power is supplied to the computer 18. Consequently, when the sequential processing is started in accordance with the flow chart illustrated in FIG. 2, the flag PK becomes "PK=1".

Referring to FIG. 2, first, in step 102, the output signal of the crank angle sensor 21 is input into the computer 18, and the engine speed N (r.p.m.) is calculated from the time interval of the production of the crank angle signals issued from the crank angle sensor 21. Then, in step 103, the output signals of the AD converter 17 and the knocking discrimination circuit 21 are input into the computer 18, and the level of vacuum P and the knocking intensity KN are stored in the RAM 23. The knocking intensity KN consists of four levels, that is KN=0, KN=1, KN=2, and KN=3. The knocking intesnity "KN=0" indicates that a knocking does not occur, but the knocking intensity "KN=1, 2 or 3" indicates that a knocking occurs. In addition, the number of KN 1, 2, or 3 indicates the intensity of the knocking.

In step 104, it is determined from the knocking intensity KN whether or not a knocking occurs. When the knocking occurs, the routine goes to step 105 and, when the knocking does not occur, the routine goes to step 117.

In the case where the knocking occurs, in step 105, the content of a knocking interval counter CKN, which content indicates the time interval of the occurrence of the successive two knockings, is compared with the above-mentioned predetermined time period $T_1$. When the content of the knocking interval counter CKN is longer than the predetermined time period $T_1$, the routine goes to step 106, and the flag PK is reset, that is, the flag PK becomes "PK=0". Contrary to this, when the content of the knocking interval counter CKN is not longer than the predetermined time period $T_1$, the routine jumps to step 107. At this time, the flag PK remains unchanged. In step 107, the knocking interval counter CKN is reset, that is, the content of the knocking interval counter CKN becomes zero. Consequently, it is understood that the knocking interval counter CKN is reset everytime the knocking occurs.

Then, in step 108, the basic retardation $\Delta Q$ of the ignition timing for the knocking intensity KN=1 is multiplied by the knocking intensity KN and, thereby, the retardation $\Delta QR$ of the ignition timing for the occurrence of the knocking is obtained. Then, in step 109, the retardation $\Delta QR$ is added to a total retardation QR of the ignition timing, and the result of the addition is put into the total retardation QR. Then, is step 110, the total retardation QR is compared with a predetermined maximum retardation QM of the ignition timing. When the total retardation QR is larger than the maximum retardation QM, the routine goes to step 111, and the maximum retardation QM is put into the total retardation QR. Contrary to this, when the total retardation QR is smaller than the maximum retardation QM, the routine jumps to step 112. Consequently, at this time, the total retardation QR remains unchanged. In step 112, it is determined whether or not the flag PK is "PK=0". When the flag PK is "PK=0", that is, when the previously mentioned conditions (a) and (b) are satisfied, the routine goes to step 113, and the level of vacuum $p_{max}$, which corresponds to the level of vacuum produced in the surge tank 12 when the engine is operating in a wide open throttle, is put into the level of vacuum P. Contrary to this, when the flag PK is "PK=1", that is, when the previously mentioned conditions (a) and (b) are not satisfied, the routine goes to step 114. In step 114, the optimum ignition timing Q, stored in the ROM 22 and determined by the engine speed N and the level of vacuum P, is read out from the RAM 23. Consequently, as it is understood from steps 112 throught 114, when the flag PK is "PK=0", the optimum ignition timing becomes equal to an ignition timing which is optimum when the engine is operating in a wide open throttle regardless of the actual level of vacuum detected by the vacuum sensor 16. Contrary to this, when the flag PK is "PK=1", the optimum ignition timing becomes equal to an optimum ignition timing corresponding to the actual level of vacuum P detectecd by the vacuum sensor 16. Then, in step 115, the total retardation QR is subtracted from the optimum ignition timing Q which is read out from the ROM 22 in step 114 and, thus, the actual ignition timing QO is obtained. Then, in step 116, the ignition control signal, corresponding to the actual ignition timing QO, is output from the computer 18 and, then the processing cycle is completed.

On the other hand, in step 104, if it is determined that the knocking intensity KN is equal to "0", that is, when a knocking does not occur, the routine goes to step 117, and the content of the knocking interval counter CKN is compared with the previously mentioned predetermined time period $T_2$. When the content of the knocking interval counter CKN is larger than the predetermined time period $T_2$, the routine goes to step 118 and, the flag PK is set, that is, the flag PK becomes "PK=1". Contrary to this, when the content of the knocking interval counter CKN is smaller than the predetermined time period $T_2$, the routine goes to step 119. In step 119, the advance QA of the ignition timing is subtracted from the total retardation QR, and the result of the subtraction is put into the total retardation QR. Then, in step 120, it is determined whether or not the total retardation QR is negative. Whent the total retardation QR is negative, the routine goes to step 121 and, "0" is input to the total retardation QR. That is, the step 121 serves to guard the optimum ignition timing Q so that the actual ignition timing QO does not become larger than the optimum ignition timing Q. Then, the routine goes to step 110. On the other hand, if it is determined in step 120 that the total retardation QR is not negative, the routine jumps to step 110.

Summarizing the calculation carried out in the flow chart illustrated in FIG. 2, the calculation is represented by the following two equations.

The actual ignition timing QO=(the optimum ignition timing Q corresponding the actual engine speed N and the actual level of vacuum P)−(the total retardation QR in the preceding processing cycle)−(the knocking intensity KN×the basic retardation ΔQ for the knocking intensity KN=1)+(the advance QA) . . . (1)

As is understood from FIG. 2, since the advancing operation of the ignition timing is not carried out when a knocking occurs, KN×ΔQ and QA do not become positive at the same time in the above equation (1). The above equation (1) is the same as that used in a conventional ignition timing control method.

However, in the present invention, the following equation is used only when the flag PK is "PK=0", that is, only when the previously mentioned conditions (a) and (b) are satisfied. The actual ignition timing QO=(-the optimum ignition timing Q corresponding to the actual engine speed N and the level of vacuum $P_{max}$ which is produced when the engine is operating in a wide open throttle)−(the total retartation QR in the preceding proccessing cycle)−(the knocking intensity KN×the basis retardation ΔQ for the knocking intensity KN=1)+(the advance QA) . . . (2).

From the equation (2), it is understood that, when the flag PK is "PK=0", the actual ignition timing QO is determined independently of the actual level of vacuum P.

FIG. 3 illustrates a data map indicating the optimum ignition timing Q which is determined by the engine speed N and the level of vacuum P. This map is stored in the ROM 22 (FIG. 2). However, instead of using such a map, a data map, indicating the optimum ignition timing Q which is determined by the engine speed N and the amount of air fed into the cylinder of the engine, may be used. In this case, an air flow meter, illustrated by the dotted line 27 in FIG. 1, is mounted on the inlet of the intake duct 14, and the optimum ignition timing Q is obtained from the output signal of the air flow meter 27 and the output singal of the crank angle sensor 21. In addition, in this case, P in FIG. 2 represents the amount of air fed into the cylinder of the engine and, in step 113 FIG. 2, $P_{max}$ represents the maximum amount of air in the actual engine speed N.

Figure 4:
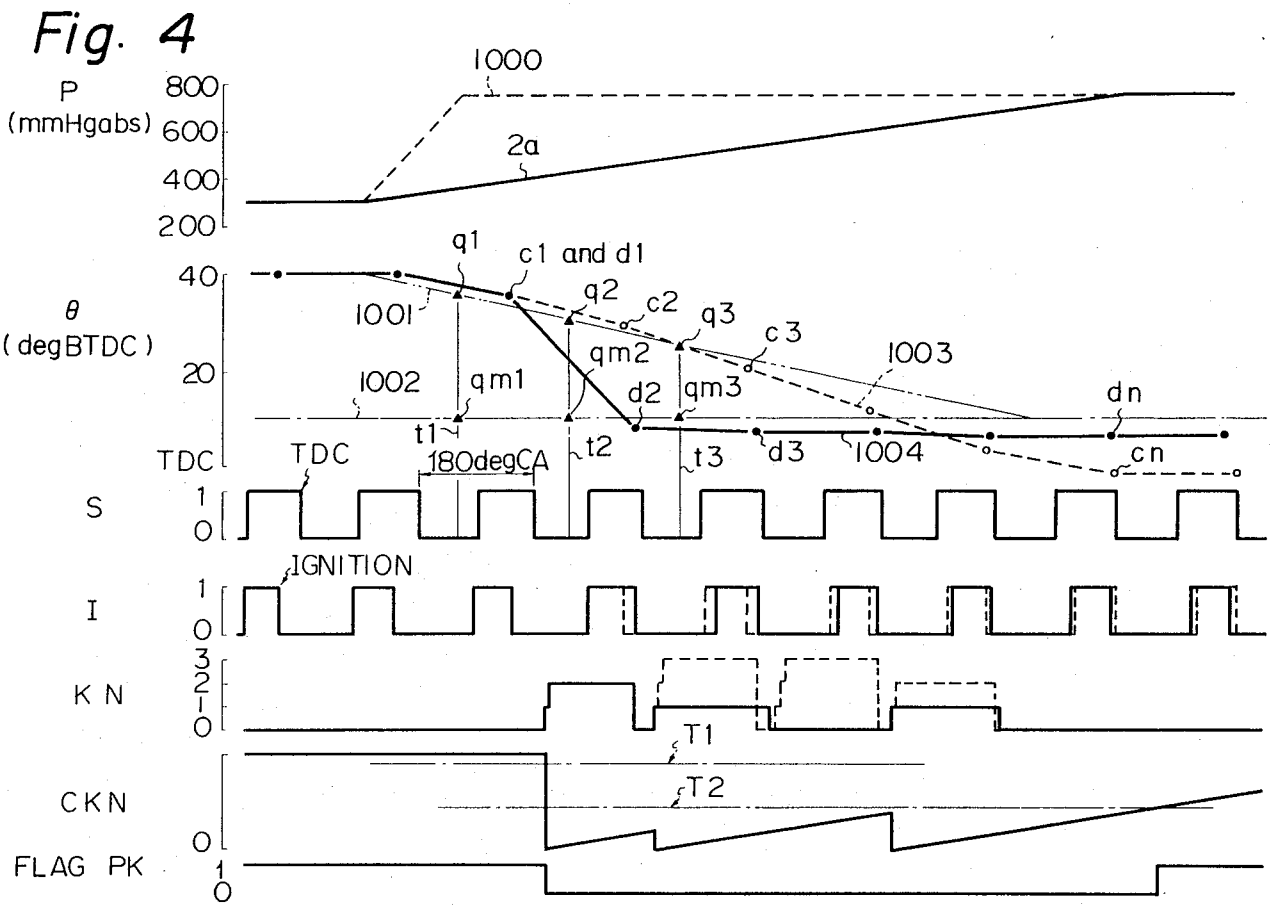
FIG. 4 is a time chart illustrating the operation of an ignition timing control device according to the present invention.

FIG. 4 illustrates a time chart in the case where the engine load is abruptly changed while maintaining the engine speed N constantly. In FIG. 2, in addition to the actual ignition time according to the present invention, the actual ignition timing used in a convention ignition timing method is also indicated. The ignition timing control method according to the present invention will be hereinafter described in further detail with reference to FIG. 4.

In FIG. 4, the dotted line 1000 indicates the actual level of vacuum P, and the solid line 2*a* indicates the level of vacuum P detected by the vacuum sensor 16. The dash-and-dotted line 1001 indicates the optimum ignition timing Q stored in the ROM 22 in the form of the data map and corresponding to the engine speed N and the level of vacuum P detected by the vacuum sensor 16. The dash-and-dotted line 1002 indicates the optimum ignition timing Q corresponding to the engine speed N and the level of vacuum $P_{max}$ which is produced when the engine is operating in a wide open throttle. Consequently, this optimum ignition timing Q is maintained constantly independent of the level of vacuum P. In addition, in FIG. 4, S indicates the TDC signal issued from the crank angle sensor 21, and the trailing edge of the pulse (when the pulse is changed from "1" to "0") indicates the top dead center TDC. I indicates the ignition control signal issued from the computer 18, and the leading edge of the pulse indicates the ignition timing. KN indicates the output signal issued from the knocking discrimination circuit 20 and indicating the knocking intensity. CKN indicates the content of the knocking interval counter CKN, and the knocking interval counter CKN is reset everytime a knocking occurs. PK indicates the content of the flag PK.

The dotted lines in Q, I nd KN of FIG. 4 indicate the actual ignition timing, the ignition control signal and the knocking intensity, respectively, in a conventional ignition time control method. In addition, $t_1$, $t_2$, and $t_3$ indicate a time at which the output signals of the crank angle sensor 21, the vacuum sensor 16, and the knocking discrimination circuit 20, that is, the output signals indicating the engine speed N, the level of vacuum P, and the knocking intensity KN, are input into the computer 18. The points q1, q2, and q3 indicate the optimum ignition timing Q at the time $t_1$, $t_2$, and $t_3$, respectively. When the flag PK is "PK=1", the actual ignition timing is calculated based on the optimum ignition timing indicated by q1, q2, and q3. The points qm1, qm2, and qm3 indicate the optimum ignition timing Q at the times $t_1$, $t_2$, and $t_3$, respectively, and at the time when the engine is operating in a wide open throttle. When the flag PK is "PK=0", the actual ignition timing is calculated based on the optimum ignition timing indicated by qm1, qm2, and qm3. The points d1, d2, and d3 . . . dn indicate the actual ignition timing QO obtained by the ignition timing control method according to the present invention, and reference numeral 1004 indicates the line interconnecting d1, d2 . . . dn. The points c1, c2, c3 . . . cn indicate the actual ignition timing obtained by a conventional ignition timing control method, and reference numeral 1003 indicates the line interconnecting c1, c2, c3 . . . cn.

In the time $t_1$ of the FIG. 4, the content of the knocking interval counter CKN is longer than in the predetermined time period $T_1$. In addition, the knocking intensity KN is "KN=0", and the flag PK is "PK=1". Consequently, at the time, in the above-mentioned equation (1), the optimum ignition timing Q becomes equal to q1 (FIG. 4). In addition, the total retardation QR becomes equal to zero, and the knocking intensity KN becomes equal to zero. Furthermore, since the total retardation QR is equal to zero, the advance QA becomes equal to zero. Consequently, at this time, the equation (1) is represented as follows.

$$QO = Q - QR - KN \times \Delta Q + QA = q1 - 0 - 0 - 0 = q1.$$

Therefore, the actual ignition timing QO becomes equal to q1, and the ignition is carried out at the time indicated by d1 in FIG. 4. In the time $t_2$ of FIG. 4, the content of the knocking interval counter CKN is longer than in the predetermined time period $T_1$. In addition, the knocking intensity KN becomes "KN=2", and the flag becomes "PK=0". Consequently, at this time, the actual ignition timing QO is calculated by the above-mentioned equation (2). Therefore, at this time, in the equation (2), the optimum ignition timing Q becomes equal to qm2 (FIG. 4), and the total retardation QR is equal to zero. In addition, since the knocking occurs, the advance QA is equal to zero. Consequently, at this time, the equation (2) is represented as follows.

$$QO = Q - QR - KN \times \Delta Q + QA = qm2 - 0 - 2 \times \Delta Q + 0 = qm2 - 2 \times \Delta Q$$

Therefore, at this time, the actual ignition timing QO becomes equal to (qm2−2×ΔQ), and the ignition is carried out at the time indicated by d2 in FIG. 4.

In the time $t_3$ of FIG. 4, the content of the knocking interval counter CKN becomes shorter than the predetermined time period $T_2$, and the knocking intensity KN becomes "KN=1". In addition, since the flag PK is maintained at "PK=0", the optimum ignition timing Q becomes equal to qm3 in FIG. 4. Furthermore, at this time, the total retardation QR becomes equal to (2×ΔQ), and the advance QA is equal to zero because the knocking occurs. Consequently, at this time, the actual ignition timing QO is calculated by the above-mentioned equation (2), and the equation (2) is represented as follows.

$$QO = Q - QR - KN \times \Delta Q + QA = qm3 - (2 \times \Delta Q) - (1 \times \Delta Q) + 0 = qm3 - 3 \times \Delta Q$$

Therefore, at this time, the actual ignition timing QO becomes equal to (qm3−3×ΔQ), and the ignition is carried out at the time indicated d3 in FIG. 4.

As is understood from the above description, in the present invention, in the case where the knocking occurs when the engine load is abruptly changed, it is possible to abruptly retard the ignition timing.

Contrary to this, in a coventional ignition timing method, since the above-mentioned equation (1) is always used, the actual ignition timing becomes equal to (q2−2×ΔQ) at the time $t_2$, and the ignition is carried out at the time indicated by c2 in FIG. 4. In addition, the actual ignition timing becomes equal to (q3−5×Q) at the time $t_3$, and the ignition is carried out at the time indicated by c3 in FIG. 4. Consequently, in a conventional ignition timing control method, since the actual ignition timing c2 and c3 is considerably advanced relative to the optimum and actual ignition timing qm2 and qm3, it is impossible to supporess the occurrence of knocking. In addition, as illustrated in FIG. 4, when the level of vacuum P detected by the vacuum sensor 16 and illustrated by reference numberal 2*a* becomes equal to the actual level of vacuum illustrated by reference numeral 1000, the actual ignition timing according to the present invention becomes equal to dn, and the actual ignition timing according to a conventional ignition control method becomes equal to cn. At this time, the actual ignition timind dn is equal to an ignition timing corresponding to the knocking occurrence limit. Contrary to this, the actual ignition timing CN according to a conventional ignition control method is considerably retarded relative to the ignition timing corresponding to the knocking occurrence limit and, thus, it takes a few seconds until the time the actual ignition timing approaches dn. Consequently, during this time, the drivability of a vehicle and the specific fuel consumption deteriorate.

Figure 5:
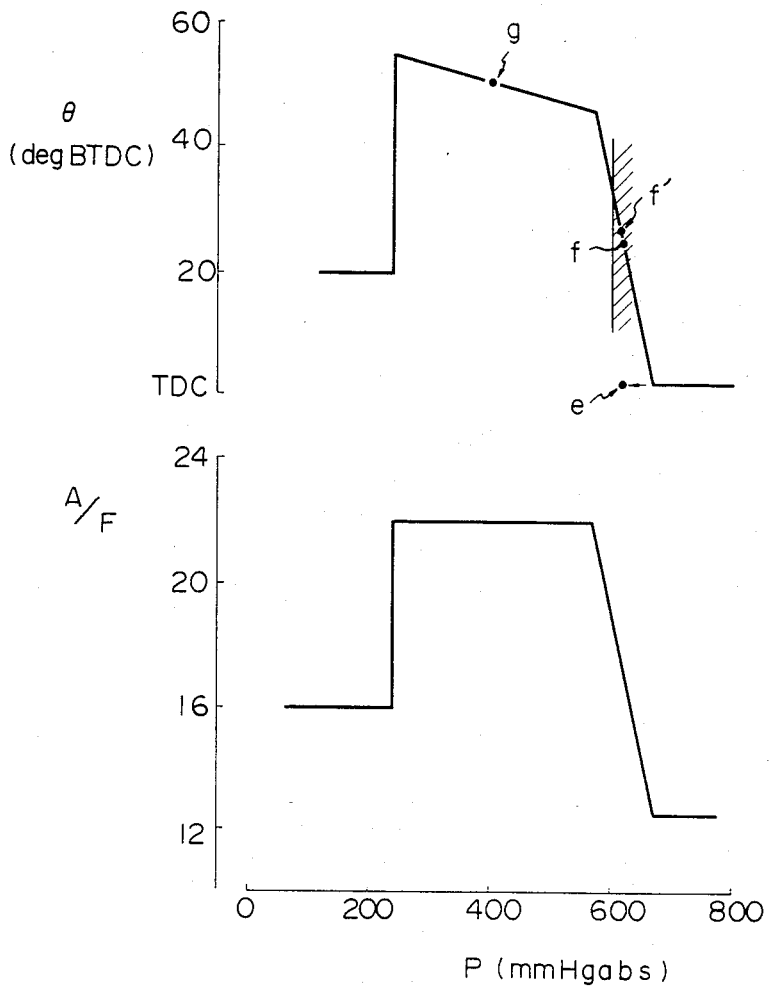
FIG. 5 is a diagram illustrating the optimum ignition timing and the air-fuel ratio which are suited for an engine mainly using a lean fuel mixture.
Figure 6:
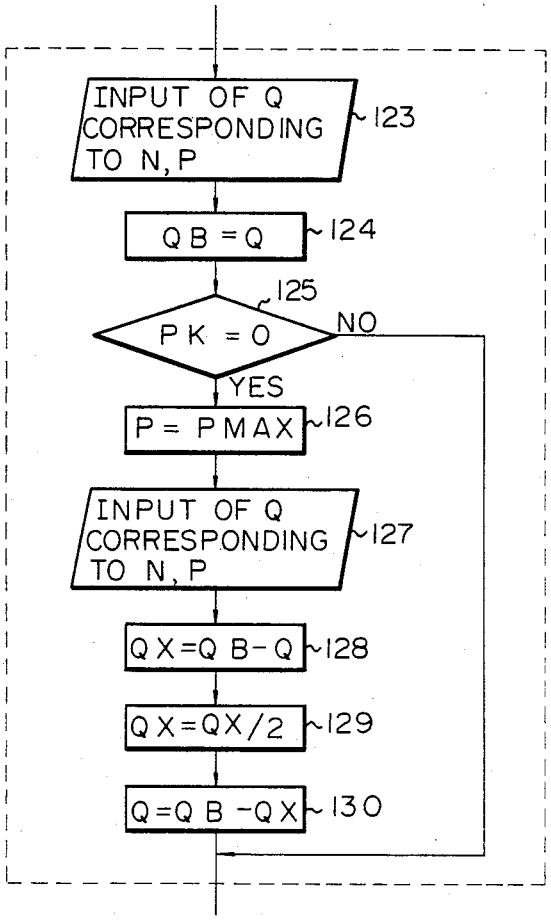
FIG. 6 is a flow chart illustrating the operation of an ignition timing control device which is suited for the engine mainly using a lean fuel mixture.

FIGS. 5 and 6 illustrate a diagram and a flow chart, respectively, for illustrating an alternative embodiment. This embodiment is suitable for an engine mainly using a lean fuel mixture. FIG. 5 illstrates the relationship between the optimum ignition timing Q and the level of vacuum P produced in the surge tank 12, and the relationship between the level of vacuum P and the air-fuel ratio A/F of an engine which mainly uses a lean fuel mixture. In addition, FIG. 6 illustrates the flow chart indicating an ignition timing control method which is suited for such an engine. In this engine, as illustrated in FIG. 5, when the engine is operating under a heavy load, a rich fuel mixture is used and, when the engine is operating under a middle load, an extremely lean fuel mixture is used. In addition, the region, in which the air-fuel ratio is continuously changed, is present between the rich fuel mixture region and the lean fuel mixture region. However, a knocking most easily occurs when the air-fuel ratio becomes equal to the stoichiometric air-fuel ratio. Consequently, in the above-mentioned engine, even if the engine is operating under a partial load illustrated by the hatching in FIG. 5, a knocking occurs. Nevertheless, in the above-mentioned ignition control method according to the present invention, when the throttle valve 15 (FIG. 1) is abruptly opened to such an extent that the level of vacuum P becomes equal to, for example, 620 mmHgabs, the optimum ignition timing is compulsorily retarded to the point e in FIG. 5 due to the occurrence of knocking. As a result of this, the actual ignition timing is retarded relative to the optimum ignition timing f and, thus, a problem occurs in that the drivability of a vehicle and the specific fuel consumption deteriorate.

FIG. 6 illustrates a flow chart which is suited for the above-mentioned engine, and the ignition timing control method will be hereinafter described with reference to the flow chart illustrated in FIG. 6. This flow chart illustrates only a portion enclosed by the dotted line in FIG. 2 and, since the remaining poriton of the flow chart illustrated in FIG. 6 is the same as that of the flow chart illustrated in FIG. 2, the description regarding the above-mentioned remaining portion is omitted here.

If the engine is accelerated from the relatively low load operating state (for example, P=400 mmHgabs), and the throttle valve 15 is opened to such an extent that the level of vacuum becomes equal to, for example, 620 mmHgabs, in step 123 of FIG. 6, the optimum ignition timing g (FIG. 5), corresponding the engine speed N and the level of vacuum P, is read out from the data map. Then, in step 124, the optimum ignition timing Q is put into QB, and the QB is stored in the RAM 23 (FIG. 1). Then, in step 125, it is determined whether or not the flag PK is "PK=0". When the flag PK is not "PK=0", the routine goes to step 115 (FIG. 2). Contrary to this, when the PK is "PK=0", the routine goes to step 126, and $P_{max}$, which is produced in the surge tank 12 (FIG. 1) when the engine is operating in a wide open throttle, is put into the level of vacuum P. Then, in step 127, the optimum ignition timing e (FIG. 5), corresponding to the engine speed N and the level of vacuum P ($=P_{max}$), is read out from the data map. Then, in step 128, the difference (g−e) between the optimum ignition timings g and e illustrated in FIG. 5 is obtained. Then, in step 129, (g−e)/2 is obtained and, in step 130, {g−(g−e)/2} is calculated. The optimum ignition timing Q, obtained in step 130, corresponds to f' near the optimum ignition timing f. Then, the routine goes to step 115 (FIG. 2). In step 115, the actual ignition timing QO is obtained by subtracting the total retardation QR from the optimum ignition timing Q and, then, in step 116, the ignition control signal is output from the computer 18. Consequently, in the engine using the fuel mixture having the air-fuel ratio illustrated in FIG. 5, it is possible to suppress the occurrence of knocking without retarding the ignition timing too much. As a result of this, it is possible to obtain a good drivability and specific fuel consumption.

According to the present invention, when the throttle valve is abruptly opened, it is possible to suppress the occurrence of knocking and prevent the ignition timing from being excessively retarded after the throttle valve is opened. As a result of this, it is possible to obtain a good drivability and improve the specific fuel consumption.

While the invention has been described by reference to specific embodiments chosen for purposes of illustration, it should be apparent that numerous modifications could be made thereto by those skilled in the art without departing from the basic concept and scope of the invention.

I claim:

1. An ignition timing control device of an internal combustion engine having an intake passage and a spark plug, said device comprising:

first means for detecting the level of vacuum produced in the intake passage and producing an output signal indicating said level of vacuum;

second means for detecting the engine speed and producing an output signal indicating said engine speed;

third means for detecting the occurrence of a knocking and producing an output signal indicating a knocking intensity; and electronic control means controlling the ignition timing of said spark plug in response to the output signals of said first means, said second means and said third means, and storing therein a data map which indicates an optimum ignition timing corresponding to said level of vacuum and said engine speed, said optimum ignition timing including a first optimum ignition timing which corresponds to said engine speed and said level of vacuum, detected by said first means, and including a second optimum ignition timing which corresponds to said engine speed and said level of vacuum produced in the intake passage when the engine is operating with wide open throttle, said electronic control means normally maintaining the ignition timing of said spark plug at said first optimum ignition timing, but retarding the ignition timing of said spark plug to the range of an ignition timing between said second optimum ignition timing and the midpoint of said first and said second optimum ignition timings when a knocking occurs.

2. A device according to claim 1, wherein the ignition timing of said spark plug is retarded to said range of the ignition timing when said knocking occurs after a first predetermined time period, during which a knocking does not occur, has elapsed.

3. A device according to claim 2, wherein the ignition timing of said spark plug is maintained at said range of the ignition timing until the time a second predetermind time period, during which a knocking does not occur, has elapsed.

4. A device according to claim 3, wherein said first predetermined time period is longer than said second predetermined time period.

5. A device according to claim 1, wherein, after said knocking has occurred, when a next knocking occurs, the retardation of the ignition timing of the spark plug is increased in accordance with an increase in the knocking intensity.

6. An ignition timing control device of an internal combustion engine having an intake passage and a spark plug, said device comprising:

first means for detecting the amount of air flowing within the intake passage and producing an output signal indicating said amount of air;

second means for detecting the engine speed and producing an output signal indicating said engine speed;

third means for detecting the occurrence of a knocking and producing an output signal indicating a knocking intensity; and electronic control means controlling the ignition timing of said spark plug in response to the output signals of said first means, said second means and said third means and storing therein a data map which indicates an optimum ignition timing corresponding to said amount of air and said engine speed, said optimum ignition timing including a first optimum ignition timing which corresponds to said engine speed and said amount of air, detected by said means, and including a second optimum ignition timing which corresponds to said engine speed and said amount of air flowing within the intake passage when the engine is engine is operating with wide open throttle, said electronic control means normally maintaining the ignition timing of said spark plug at said first optimum ignition timing, but retarding the ignition timing of said spark plug to the range of an ignition timing between said second optimum ignition timing and the midpoint of said first and said second optimum ignition timings when a knocking occurs.

7. A device according to claim 6, wherein the ignition timing of said spark plug is retarded to said range of the ignition timing when said knocking occurs after a first predetermined time period, during which a knocking does not occur, has elapsed.

8. A device according to claim 7, wherein the ignition timing of said spark plug is maintained at said range of the ignition timing until the time a second predetermined time period, during which a knocking does not occur, has elapsed.

9. A device according to claim 8, wherein said first predetermined time period is longer than said second predetermined time period.

10. A device according to claim 6, wherein, after said knocking has occurred, when a next knocking occurs, the retardation of the ignition timing of said spark plug is increased in accordance with an increase in the knocking intensity.

* * * * *

UNITED STATES PATENT AND TRADEMARK OFFICE

CERTIFICATE OF CORRECTION

PATENT NO. : 4,513,717

DATED : April 30, 1985

INVENTOR(S) : Tatsuo Kobayashi

It is certified that error appears in the above-identified patent and that said Letters Patent is hereby corrected as shown below:

Column 4, line 9, change "unitil" to --until--.

Column 4, line 27, change "is KN" to --is, KN--.

Column 4, line 28, change "intesnity" to --intensity--.

Column 4, line 62, change "is" to --in--.

Column 5, line 26, change "detectecd" to --detected--.

Column 5, line 50, change "Whent" to --When--.

Column 5, line 63, change "the actual" to --to the actual--.

UNITED STATES PATENT AND TRADEMARK OFFICE

CERTIFICATE OF CORRECTION

PATENT NO. : 4,513,717

DATED : April 30, 1985

INVENTOR(S) : Tatsuo Kobayashi

It is certified that error appears in the above-identified patent and that said Letters Patent is hereby corrected as shown below:

Column 6, line 14, change "retartation" to --retardation--.

Column 6, line 33, change "singal" to --signal--.

Column 6, line 42, change "convention" to --conventional--.

Column 7, line 52, change"FIG. 4. In the---" to -------FIG. 4.

In the------

Column 7, line 56, change "flag" to --flag PK--.

Column 8, lines 16-20, change ΔQ-" to --ΔQ + QA--; change"3x-" to --3x + ΔQ--.

UNITED STATES PATENT AND TRADEMARK OFFICE

CERTIFICATE OF CORRECTION

PATENT NO. : 4,513,717

DATED : April 30, 1985

INVENTOR(S) : Tatsuo Kobayashi

It is certified that error appears in the above-identified patent and that said Letters Patent is hereby corrected as shown below:

Column 8, line 39, change "supporess" to --suppress--.

Column 8, line 42, change "numberal" to --numeral--.

Column 8, line 48, change "timind" to --timing--.

Column 9, line 28, change "poriton" to --portion--.

Column 9, line 37, change "corresponding the---" to --corresponding to the-----.

Column 9, line 40, change "the QB" to --this QB--.

Column 10, line 63, change "the" to --said--.

Column 11, line 19, change "said means" to --said first means--.

Column 11, line 22, omit first "engine is".

Signed and Sealed this

*Eighth* Day of *October 1985*

[SEAL]

*Attest:*

*Attesting Officer*

DONALD J. QUIGG

*Commissioner of Patents and Trademarks—Designate*